US006169851B1

(12) United States Patent
Naughton et al.

(10) Patent No.: US 6,169,851 B1
(45) Date of Patent: Jan. 2, 2001

(54) SPACE HEATERS

(75) Inventors: Martin Lawrence Naughton, Slane (IE); Ronald Michael Warren, Maidenhead (GB); Arthur Joseph Patrick Purton, Dundalk (IE)

(73) Assignee: Basic Patents, Ballsbridge (IE)

( * ) Notice: Under 35 U.S.C. 154(b), the term of this patent shall be extended for 0 days.

(21) Appl. No.: 09/214,684

(22) PCT Filed: Jul. 11, 1997

(86) PCT No.: PCT/GB97/01885

§ 371 Date: Jul. 29, 1999

§ 102(e) Date: Jul. 29, 1999

(87) PCT Pub. No.: WO98/02696

PCT Pub. Date: Jan. 22, 1998

(30) Foreign Application Priority Data

Jul. 12, 1996 (GB) ..... 9614748
Feb. 14, 1997 (GB) ..... 9703040

(51) Int. Cl.[7] ..... F24C 1/14

(52) U.S. Cl. ..... 392/378; 392/355; 392/373; 392/375

(58) Field of Search ..... 392/347, 355, 392/365, 373, 375, 378, 497; 165/104.23, 128, 129, 130, 131, 170, 171, 176; 219/385, 386, 523, 533, 538

(56) References Cited

U.S. PATENT DOCUMENTS 1,731,624 * 10/1929 Henry ..... 392/378
2,761,950 * 9/1956 Tagliaferri et al. ..... 392/378
2,797,295 * 6/1957 Aitken-SMith et al. ..... 392/378
4,493,974 * 1/1985 Ganek et al. ..... 392/373
4,870,253 * 9/1989 De'Longhi ..... 392/365
4,873,421 * 10/1989 Brehmer et al. ..... 392/378
4,904,846 * 2/1990 Oscadal ..... 392/378
5,076,350 * 12/1991 Grantz et al. ..... 392/378
5,341,455 * 8/1994 De'Longhi ..... 392/378
5,685,365 * 11/1997 De'Longhi ..... 165/170
6,009,935 * 1/2000 Shiret ..... 392/378

FOREIGN PATENT DOCUMENTS

34938/78 10/1979 (AU) .
198368 9/1938 (CH) .
218314 3/1942 (CH) .
1 679 446 1/1970 (DE) .
781904 5/1935 (FR) .
437322 10/1935 (GB) .
1104886 3/1968 (GB) .

* cited by examiner

*Primary Examiner*—Teresa Walberg
*Assistant Examiner*—Fadi H. Dahbour
(74) *Attorney, Agent, or Firm*—Bromberg & Sunstein LLP

(57) ABSTRACT

A space heater is disclosed, comprising a housing, a heat source within the housing and a plurality of openings to allow the convection of air through the housing, in which:

the heat source comprises a pair of panels defining between them a closed compartment, a liquid within and partially filling the compartment and an electrical heating element extending within the compartment, substantially parallel to the panels and in thermal contact with the liquid;

the compartment is sub-divided into a lower liquid chamber and an upper expansion chamber and the cross-sectional area of the liquid chamber where it meets the expansion chamber is less than that of the expansion chamber; and the openings in the housing allow radiant heat from the heat source to escape from the housing.

In further embodiments, the lower liquid chamber contains liquid at room temperature, but the upper expansion chamber does not.

29 Claims, 2 Drawing Sheets

SPACE HEATERS

BACKGROUND TO THE INVENTION

Space heaters generally divide into two types. The first type is the so-called "radiator", which usually consist of a fluid-filled body having a large surface area and which dissipates appreciable amounts of heat by radiation. The second type is the so-called "convector heater". Convector heaters consist of a housing, a heat source within the housing and a plurality of openings which allow air to convect through the housing and over the heat source. In an electrical convector heater, for example, the heat source is a resistive heating element; in a storage heater, the primary heat source may again be a resistive heating element, but the primary source acts to heat a secondary heat source, usually in the form of a stack of bricks, in a charging mode. The secondary heat source releases heat to the convecting air when the heater is in a space heating mode. Convector heaters dissipate only very small quantities of heat by radiation.

Convector heaters are regarded as generally unsatisfactory as room heaters for a number of reasons. Firstly, because most of the heat is dissipated by convection, the tendency is for hot air from the heater to rise to and collect in the ceiling. As time goes on, more and more hot air collects in the ceiling and progressively lower regions of the room heat up. However, since the heat transfer from the heater to the room is effected by heating the air as it passes over the heat source in the heater, this has the effect of gasifying any water vapour in the air, which then condenses on cool surfaces in the room. Consequently, the air collecting in the ceiling is rather dry and unpleasant to breath. Hitherto, there has been no real alternative to conventional convector heaters, apart from fan heaters, which are both noisy and relatively inefficient.

Radiators, on the other hand, heat relatively little by convection and consequently do little to take the chill off the air. Rather, radiators tend to heat surfaces in the room which are faced by the radiating surface. For a person sitting next to a radiator, this can result in one of his sides being warm and the other cold. In addition, radiators are relatively large compared with convector heaters, since the temperature to which the radiating surface can be heated is limited by safety considerations. They do, however, preserve the pleasant humidity of the air.

SUMMARY OF THE INVENTION

The present invention involves a new kind of space heater from the convector heater mould, but which tends to preserve the humidity of the air. A space heater according to the invention comprises a housing, a heat source within the housing and a plurality of openings to allow the convection of air through the housing, in which the heat source comprises a pair of panels defining between them a closed compartment, a liquid within the compartment and an electrical heating element within the compartment and in thermal contact with the liquid and in which the openings in the housing allow radiant heat from the heat source to escape from the housing.

As will be readily understood, this space heater heats both by convection through the housing and by radiation from the panels of the heat source. Adjustment of the physical parameters of the heater allows a better balance between the convective and radiative mechanisms to provide a more pleasant heat. In addition, the panels of the heat source can be painted black to promote radiation, since the heat source will in large measure be hidden by the housing. Indeed, painting the heat source black makes it even less visible.

The best way of ensuring that radiated heat can escape from the housing is to perforate one or both sides of the housing to form a grille. For convected heat, on the other hand, it is the top of the housing which should be perforated to form a grille. Clearly, the radiative processes are encouraged if at least one of the panels of the heat source faces outward through at least one of the grilles.

For convenience, the space heater may be portable; for example, the housing may be provided with wheels or castors.

Because the heat source is contained within the housing, and therefore kept away from prying fingers or accidental contact, the temperature of the heat source may rise well above the permissible safety limit for exposed heaters. As a result, the liquid within the heat source will expand to a greater extent. The danger is that the liquid within the compartment may expand to the extent that the increase in pressure in the heat source causes deformation, such as so-called "pillow" distortion, of the panels themselves. This will stress the peripheral seam between the panels of the heat source and any spot welds which may exist in the body of the heat source. Indeed, the pressure applied to the panels may be enough to cause one or more of the spot welds or, over time, the peripheral seam to burst apart, allowing hot liquid to escape under pressure.

This problem is addressed in a preferred embodiment of the invention, in which the liquid partially fills the compartment and the compartment is sub-divided into a lower liquid chamber, which at room temperature contains liquid, and an enlarged upper expansion chamber, which at room temperature contains no liquid. The advantages of this arrangement will be discussed below.

Although the problem which the preferred embodiment of the invention addresses has been described above in relation to a space heater having a housing and a heat source, the solution to that problem is applicable to a wider field.

It is applicable in particular to any situation where a heat source is not constrained in temperature by safety considerations or where there is a greater risk than usual of deformation of the panels of the heat source. Thus, this wider application of the present invention is embodied by a space heater in which the heat source comprises a pair of panels defining between them a closed compartment, a liquid partially filling the compartment and an electrical heating element within the compartment and in thermal contact with the liquid, in which the compartment is subdivided into a lower liquid chamber, which at room temperature contains liquid, and an enlarged upper expansion chamber, which at room temperature contains no liquid.

An advantage of this arrangement is that when the liquid expands, air is compressed in the enlarged expansion chamber to relieve the pressure which would otherwise build up. The degree of alleviation of the pressure depends upon a number of factors including the ratio of the volume of the expansion chamber to that of the compartment as a whole. Strictly speaking, it is the fraction of the volume of the compartment which is not filled with liquid at room temperature which determines the pressure within the chamber at any particular temperature, but the ratio of the volume of the expansion chamber to that of the compartment as a whole gives an upper limit on pressure. The ratio chosen will depend upon a number of factors including the working temperature of the heat source, the coefficient of volumetric expansion of the liquid and the highest pressure which the heat source can safely withstand, but the range for a preferred embodiment of the present invention is between 40% and 60%.

In a preferred embodiment, the upper expansion chamber is enlarged to the extent that the horizontal cross-sectional area of the lower liquid chamber where it meets the expansion chamber is less than that of the expansion chamber.

In a further preferred embodiment there is provided, a space heater comprising a housing, a heat source within the housing and a plurality of openings to allow the convection of air through the housing, in which:

the heat source comprises a pair of panels defining between them a closed compartment, a liquid within and partially filling the compartment and an electrical heating element extending within the compartment, substantially parallel to the panels and in thermal contact with the liquid;

the compartment is sub-divided into a lower liquid chamber and an upper expansion chamber and the horizontal cross-sectional area of the liquid chamber where it meets the expansion chamber is less than that of the expansion chamber; and the openings in the housing allow radiant heat from the heat source to escape from the housing.

To ensure that the expansion chamber is working effectively, the physical parameters of the space heater are preferably such that, at the working temperature of the heat source, at most a fraction of the expansion chamber is filled with liquid. At best, at the working temperature of the heat source, no part of the expansion chamber is filled with liquid.

In addition to the expansion chamber, it is preferred that the liquid chamber be enlarged. Accordingly, the liquid chamber may also occupy between 40% and 60% of the volume of the compartment. The heat source may be substantially symmetric in a horizontal plane, so that no difficulties are encountered in assembling the heat source from the two panels if one panel is turned through a half turn after being formed.

For completeness, it will be appreciated that the liquid chamber and the expansion chamber do not in general account for all of the compartment. There may also be an intermediate region, which at room temperature is at most partially filled with liquid. This intermediate region communicates between the liquid chamber and the expansion chamber, e.g. via at least one vertical channel. The intermediate region thus occupies between 5% and 15% of the volume of the compartment.

At the working temperature of the heat source, the intermediate region will be at least partially filled with liquid. For best results from the expansion chamber, it is preferred that, at the working temperature of the heat source, the intermediate region is substantially or fully filled with liquid.

To achieve high heat output to surface area ratio for the heat source, its working temperature is preferably in excess of 100 or even 150° C. For example, it may be between 120 and 250° C. By working temperature is meant the temperature to which the heat source will rise when the heating element is operating at its nominal power rating; or, put simply, the temperature to which the heat source will rise when the heater is connected to the mains supply for which it is designed or adapted.

For completeness, the following preferred parameters are set out. The thermal coefficient of volumetric expansion of the fluid is preferably between 0.00095 and 0.0012 per ° C. At room temperature, the gauge pressure within the compartment is preferably between −0.5 and 0 bar. At the working temperature of the heat source, the gauge pressure within the compartment is preferably between 0 and 1.0 bar, or maybe between 0 and 0.75 bar.

BRIEF DESCRIPTION OF THE DRAWINGS

The present invention will now be described by way of example with reference to the accompanying drawings in which.

DETAILED DESCRIPTION OF THE INVENTION

Figure 1:
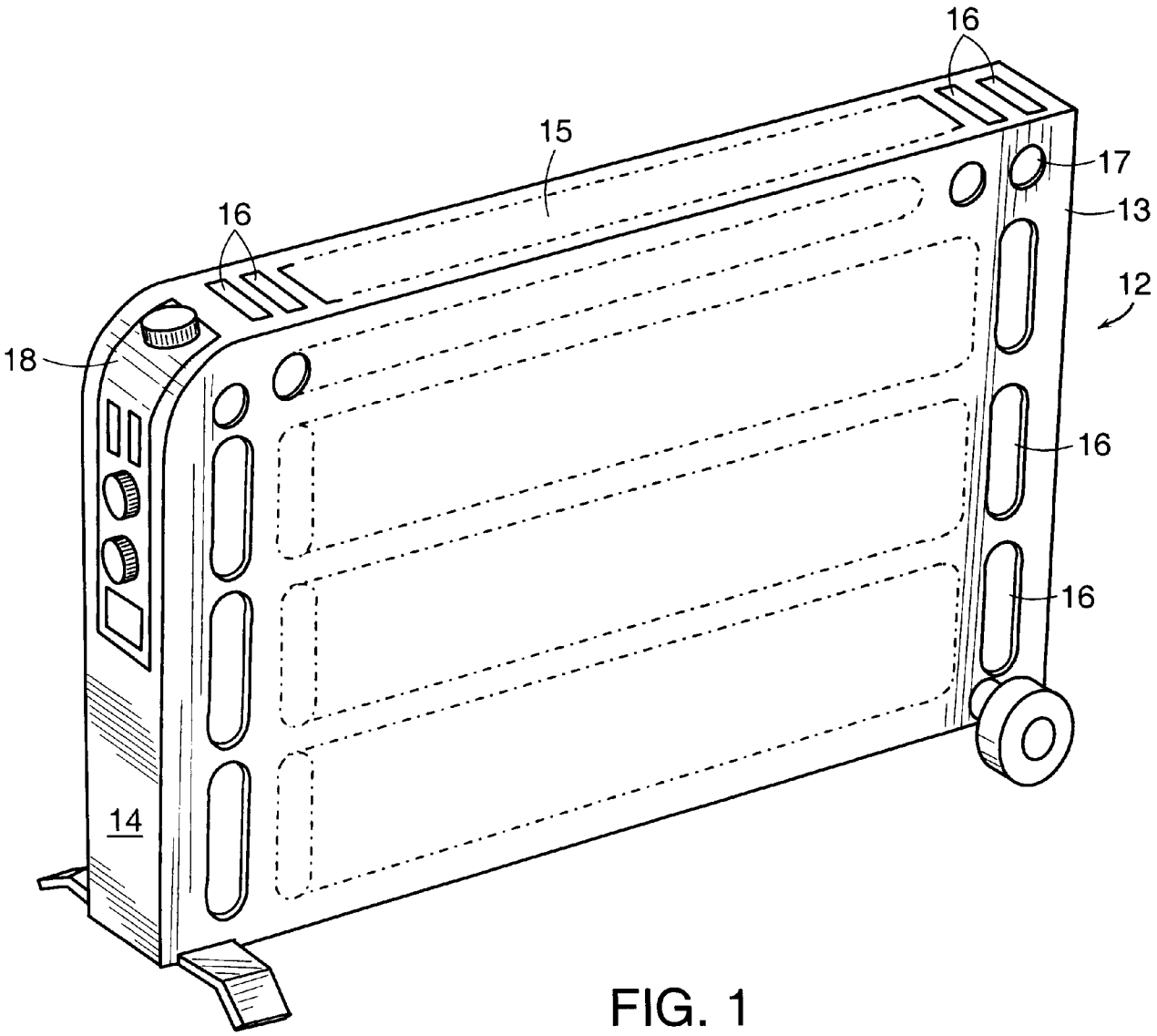
FIG. 1 is a perspective view of the space heater.

As can be seen from FIG. 1, the space heater comprises a housing or outer casing 12, within which a heat source 1 is located. The outer casing 12 is open at the bottom and consists of front and back panels 13, side panels 14 and top panel 15. The front and rear panels 13 and the top panel 15 are each perforated or slotted to form a grille 16, 17 which assists with dissipating heat by convection. Cold air enters the bottom of the casing 12, rises over the heat source 1 and emerges through the grilles 16, 17. The heat source is lined up within the casing so as to lie parallel to the side panels 13. The surfaces of the heat source therefore face outwards through the grilles 16, 17 in the side panels 13 of the casing 12.

The space heater heats both by convection through the casing 12 and by radiation from the heat source. The size and distribution of the slots and holes in the casing 12 will be selected to achieve an appropriate balance between radiation and convection losses. The heat source is painted black to promote radiation.

A control panel 18, the construction and operation of which is well known, is fitted to the outer casing 12 and it would normally include a thermostat and other controls for the electrical element of the heat source. Castors 18 are fitted to the base of the casing 12.

Figure 3:
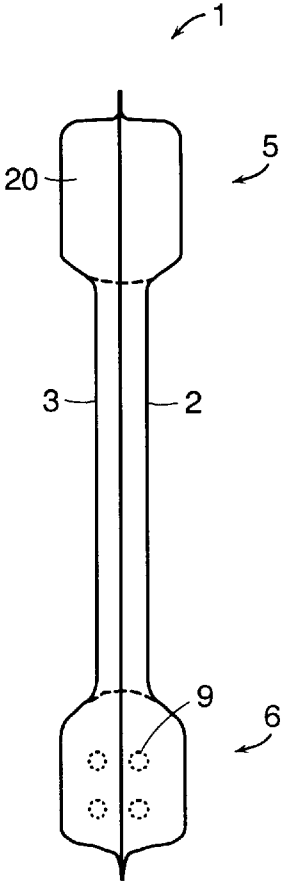
FIG. 3 is a side elevation of heat source.
Figure 2:
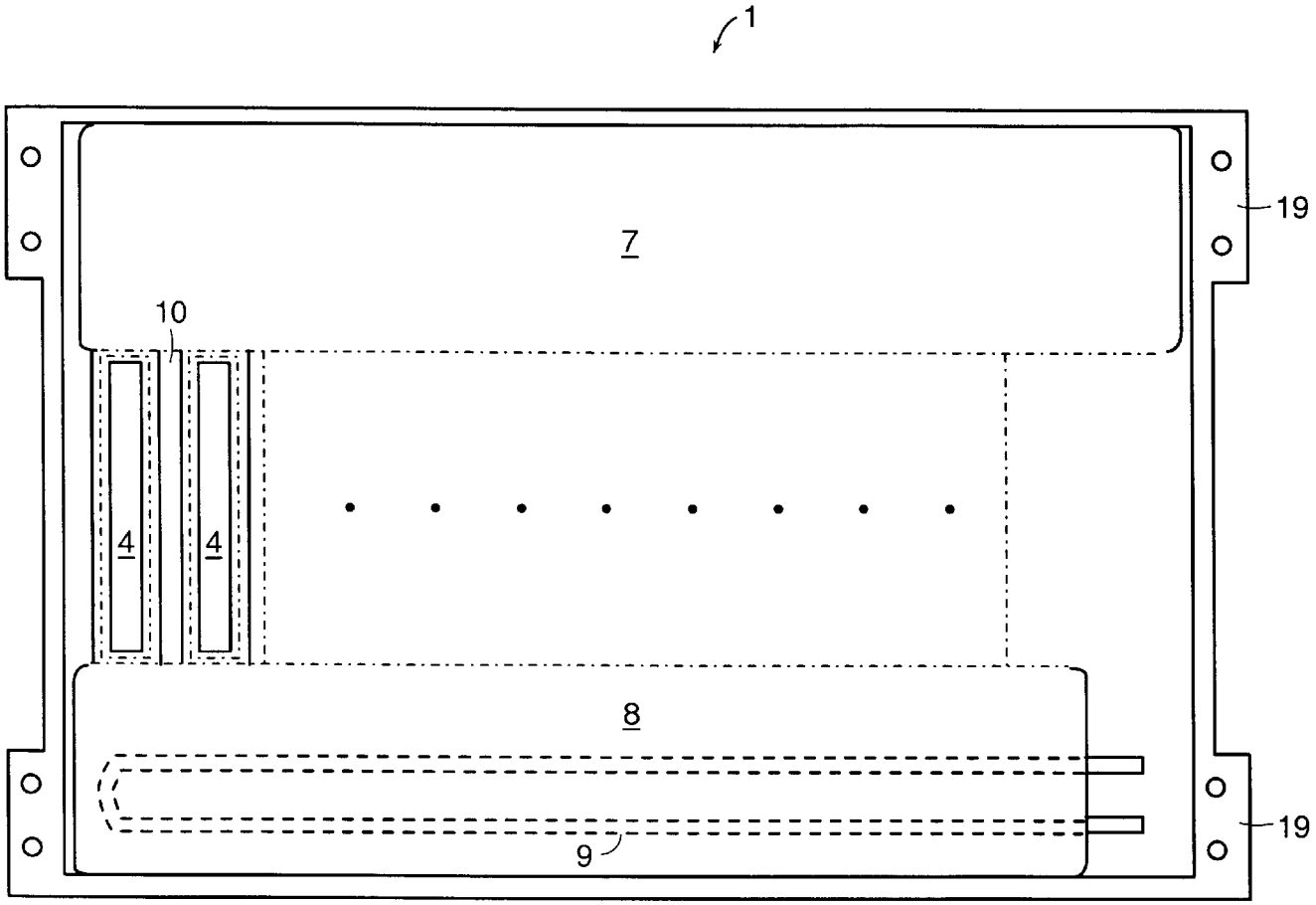
FIG. 2 is a front view of the heat source.

As shown in FIGS. 2 and 3, the heat source 1 includes front and rear panels 2, 3, each having a row of dimples 4 with vertical channels 10 between them. Connecting lugs 19 are provided on the panels 2, 3 to allow attachment of the heat source to the casing 12. The panels 2, 3 are formed from 0.7 mm thick mild steel thick. The dimples are pressed into the panels so that they extend inwardly and corresponding dimples touch one another within the heat source. This enables the dimples to be spot welded together, where their internal surfaces contact one another, so as to form bridges between the panels to maintain the proper spacing of the panels.

Respective top and bottom portions 5, 6 of each panel are pressed into a semi-cylindrical or semi-elliptical shape, such that the front and rear panels define an enlarged barrel-like expansion chamber 7 at the top and an oil chamber 8 at the bottom. The panels are symmetric in a horizontal plane, so that no difficulties are encountered in assembling the heat source from the two panels if one panel is turned through a half turn after being formed.

The expansion chamber 7 is generally empty, as will be explained, but the oil chamber 8, which contains an electrical heating element or elements 9, is full of oil, even when the heat source is at room temperature. The front and rear panels 2, 3 are peripherally sealed, e.g. by a seam weld, to form an enclosed compartment 20 including both the expansion chamber 7 and the oil chamber 8. The heating element 9 is sealed into the oil chamber 8.

Before the heat source 1 is hermetically sealed, oil is introduced into the compartment 20 formed between the panels 2, 3. This oil may be heated, to reduce its viscosity and thus facilitate filling, to around 70° C. However, if the oil were at room temperature, it would normally fill the oil chamber 8 without intruding very far, if at all, into the intermediate region between the oil chamber and the expansion chamber. It is preferable, at this stage, and further to reduce the working pressure of the heat source, to introduce a vacuum into the compartment 20 before sealing it. The vacuum will typically be around −0.5 bar and is created by use of a vacuum pump in a similar way as in the manufacture of refrigeration circuits. For example, during manufacture a vacuum of approximately −0.5 Bar is pulled in the oil chamber before it is sealed by crimping and soldering. The vacuum introduced in the chamber is preferably chosen taking into account parameters associated with the heater, for example, the thermal coefficient of volume expansion of the oil and the ratio of the volume of the expansion chamber to that of the compartment, so that even when the heat source is at the working temperature, a negative pressure is maintained in the chamber.

When the heating element is switched on, the oil is heated and it begins to expand and therefore rise up the vertical channels 10. In the absence of a thermostat, the heat source would reach a final working temperature which would vary slightly with differences in ambient temperature. If a thermostat is fitted to the heater, the maximum operating temperature would be achieved with the thermostat on its highest setting. In either case, the heat source is designed to reach a maximum temperature in excess of 100° C., preferably 120–250° C. These temperatures are feasible because the heat source 1 is contained within the casing 12, and therefore kept out of harm's way.

With reference to FIG. 3, it will be noted that both the expansion chamber 7 and the oil chamber 8 are defined by enlargements. They preferably occupy about 40% of the total volume of the compartment each. The amount of oil introduced into the oil chamber of the heat source 1 and the dimensions of the expansion chamber 7 etc. are such that, when the oil reaches its working temperature, the oil level is approximately level with the bottom of the expansion chamber 7. In other words, it does not enter the expansion chamber 7 to any significant extent. The expansion chamber remains largely empty, apart from air which is compressed as the oil expands. However, in some cases, the oil may rise a small distance into the pressure chamber 7, without compromising its effectiveness.

In a representative space heater, in accordance with the invention, the total capacity of the compartment in the heat source is in the region of 7.75 litres. The oil chamber 8 is then filled with an amount of oil which occupies 3.5 litres at room temperature. In practice, the viscosity and to assist filling. The amount of oil added will depend upon a number of factors including the working temperature of the heat source, the coefficient of volumetric expansion of the liquid and the highest pressure which the heat source can safely withstand.

A 2.0 kW electrical heating element is fitted which results in an working temperature of 200° C. With this rise in temperature, the oil will expand by about 0.675 litres, i.e. by about 19% of its volume. This is due to the high coefficient of volumetric expansion of the oil. The expansion of the oil causes air, trapped within the body of the heat source, to be compressed into the expansion chamber 7. The aim is to design the pressure chamber 7 so that the pressure of the compressed air, with the oil at its working temperature, does not exceed about 1.0 (and preferably 0.3) bar. This pressure is low enough to avoid excessively stressing of the seam and the spot welds of the heat source.

Experiments have shown that heat output comprising up to 67% radiation and 33% convection can be achieved in the heater according to the invention.

In an optional embodiment, a single spot weld is used to join corresponding dimples in panels 2 and 3 together. The spot weld is typically centrally located just below upper chamber 20. The purpose of this is to provide a weak spot that would rupture above the oil level at a pressure low enough to be safe in the event of a fault. For example, it can be envisaged that if there is an oil leak, such that the oil level reaches a critical low level resulting in the breakdown (cracking) of the oil and the generation of gases building up pressure in the panel. Normally, a cut-out would operate in response to the rise in oil/sump temperature. The single spot weld on rupturing relieves the pressure above the oil level by forming a hole in the panel.

Additional spot welds may be provided if the design criteria for the heater as a whole allow for their rupture and consequent release of pressure on failure. Alternative, or additional, frangible means for release of pressure on failure may also be provided. Alternatively, the outer seam weld joining the panels is arranged to rupture to relieve the pressure above the oil level. Prior to this the panels are arranged to deform to accommodate some of the increase in pressure. To this end the steel panels are typically of a thickness of 0.5 to 1 mm (preferably around 0.7 mm).

What is claimed is:

1. A space heater comprising a housing, a heat source within the housing and a plurality of openings to allow the convection of air through the housing, in which:

the heat source comprises a pair of panels defining between them a closed compartment, a liquid within and partially filling the compartment and an electrical heating element extending within the compartment, substantially parallel to the panels and in thermal contact with the liquid;

the compartment is sub-divided into a lower liquid chamber and an upper expansion chamber and the cross-sectional area of the liquid chamber where it meets the expansion chamber is less than that of the expansion chamber; and the openings in the housing allow radiant heat from the heat source to escape from the housing.

2. A space heater according to claim 1 in which at least one side of the housing is perforated to form a grille.

3. A space heater according to claim 2 in which the top of the housing is perforated to form a grille.

4. A space heater according to claim 3 in which at least one of the panels of the heat source faces outward through at least one of the grilles.

5. A space heater according to claim 1 which is portable.

6. A space heater according to claim 5 in which the housing is provided with wheels or castors.

7. A space heater according to claim 1 in which at room temperature the lower liquid chamber contains liquid and the upper expansion chamber contains no liquid.

8. A space heater having a heat source which comprises a pair of panels defining between them a closed compartment, a liquid partially filling the compartment and an electrical heating element within the compartment and in thermal contact with the liquid, in which the compartment is sub-divided into a lower liquid chamber, which at room temperature contains liquid, and an upper expansion chamber, which at room temperature contains no liquid and in which the horizontal cross-sectional area of the liquid chamber where it meets the expansion chamber is less than that of the expansion chamber.

9. A space heater according to claim 8 in which the expansion chamber occupies between 40% and 60% of the volume of the compartment.

10. A space heater according to claim 9 in which, at the working temperature of the heat source, at most a fraction of the expansion chamber is filled with liquid.

11. A space heater according to claim 10 in which, at the working temperature of the heat source, no part of the expansion chamber is filled with liquid.

12. A space heater according to claim 11 in which the liquid chamber is enlarged.

13. A space heater according to claim 12 in which the liquid chamber occupies between 40% and 60% of the volume of the compartment.

14. A space heater according to claim 12 in which the heat source is substantially symmetric in a horizontal plane.

15. A space heater according to claim 12 in which the compartment also includes an intermediate region, which at room temperature is at most partially filled with liquid.

16. A space heater according to claim 15 in which the intermediate region includes at least one vertical channel communicating between the liquid chamber and the expansion chamber.

17. A space heater according to claim 16 in which the intermediate region occupies between 5% and 15% of the volume of the compartment.

18. A space heater according to claim 15 in which, at the working temperature of the heat source, the intermediate region is at least partially filled with liquid.

19. A space heater according to claim 18 in which, at the working temperature of the heat source, the intermediate region is substantially or fully filled with liquid.

20. A space heater according to claim 18 in which the working temperature of the heat source is in excess of 100° C.

21. A space heater according to claim 20 in which the working temperature of the heat source is between 120 and 250° C.

22. A space heater according to claim 8 in which the thermal coefficient of volumetric expansion of the fluid is between 0.00095 and 0.0012 per ° C.

23. A space heater according to claim 22 in which, at room temperature, the gauge pressure within the compartment is between −0.5 and 0 bar.

24. A space heater according to claim 23 in which, at the working temperature of the heat source, the gauge pressure within the compartment is between 0 and 1.0 bar.

25. A space heater according to claim 8 in which a frangible connection is provided from one panel to another which on rupture, under pressure, causes a hole in one or other of the panels so as to release any excess pressure.

26. A space heater according to claim 25, in which the frangible connection is one spot weld.

27. A space heater comprising:

a housing having at least one side and a top;

a heat source within the housing, the heat source including
- a pair of panels defining between them a closed compartment,
- a liquid within the compartment, and
- an electrical heating element within the compartment and in thermal contact with the liquid; and a plurality of openings to allow the convection of air through the housing, in which the openings in the housing allow radiant heat from the heat source to escape from the housing;

wherein at least one side of the housing is perforated to form a grille, and the top of the housing is perforated to form a grille, wherein at least one of the panels of the heat source faces outward through at least one of the grilles, wherein the liquid partially fills the compartment and the compartment is sub-divided into (i) a lower liquid chamber, which at room temperature contains liquid, (ii) an enlarged upper expansion chamber, which at room temperature contains no liquid, and (iii) an intermediate region, which at room temperature is at most partially filled with liquid, and wherein the intermediate region includes at least one vertical channel communicating between the liquid chamber and the expansion chamber.

28. A space heater according to claim 27, wherein the space heater is portable, and the housing is provided with wheels or castors.

29. A space heater according to claim 27, wherein a frangible connection is provided from one panel to another which on rupture, under pressure, causes a hole in one or other of the panels so as to release any excess pressure.

* * * * *